United States Patent [19]

Achelpohl

[11] 4,268,346

[45] May 19, 1981

[54] APPARATUS FOR MAKING TANK TOP BAGS FROM A WEB OF TUBULAR PLASTICS FILM PROVIDED WITH SIDE FOLDS

[75] Inventor: Fritz Achelpohl, Lengerich of Westphalia, Fed. Rep. of Germany

[73] Assignee: Windmoller & Holscher, Lengerich, Fed. Rep. of Germany

[21] Appl. No.: 60,204

[22] Filed: Jul. 24, 1979

[30] Foreign Application Priority Data

Jul. 28, 1978 [DE] Fed. Rep. of Germany ..... 2833232

[51] Int. Cl.[3] ..... B31B 1/86; B31B 21/14; B31B 21/16

[52] U.S. Cl. ..... 156/510; 156/443; 156/497; 156/515; 493/194

[58] Field of Search ..... 156/251, 250, 227, 267, 156/443, 510, 515, 568; 93/33 H, DIG. 1, 35 H

[56] References Cited

U.S. PATENT DOCUMENTS

| | | | |
|---|---|---|---|
| 3,607,573 | 9/1971 | Michaelides et al. | 156/515 |
| 3,671,350 | 6/1972 | Westlake, Jr. | 156/510 |
| 3,805,683 | 4/1974 | Hook | 93/33 H |
| 3,813,998 | 6/1974 | Lotto | 93/33 H |
| 3,893,884 | 7/1975 | Class | 156/510 |
| 3,966,524 | 6/1976 | Lehmacher | 93/33 H X |
| 4,083,747 | 4/1978 | Rochla | 156/515 X |
| 4,131,503 | 12/1978 | Plate | 93/33 H X |

*Primary Examiner*—Michael G. Wityshyn
*Attorney, Agent, or Firm*—Fleit & Jacobson

[57] ABSTRACT

Carrier bags resembling tank tops or singlets with cut-outs at the top for defining the handles are made by intermittently feeding a flattened tubular plastics web to a welding station where transverse weld seams are applied and bag sections are successively severed from the leading web end while the web is clamped between jaws. Each bag section is received by a suction belt conveyor with the assistance of a pressure roller and is then transferred to a suction drum which co-operates with a cutting cylinder for forming the cut-out and is provided with a projectable and retractable blade for folding the bag section transversely.

8 Claims, 3 Drawing Figures

APPARATUS FOR MAKING TANK TOP BAGS FROM A WEB OF TUBULAR PLASTICS FILM PROVIDED WITH SIDE FOLDS

The invention relates to an apparatus for making tank top bags from an intermittently fed web of tubular plastics film provided with side folds, comprising cyclically operating transverse welding and separating means severing tube sections from the web that have weld seams at both ends, a belt conveyor taking the tube sections away, and stamping means for cutting out the tank top cut-outs.

Compared with carrier bags having handle-hole cut-outs which are usually provided with reinforcement, so-called tank top bags have the advantage that they can be made particularly simply and therefore cheaply. To produce a tank top bag it is merely necessary to provide a U-shaped cut-out at one side of a section which is severed from a tubular film provided with side folds and closed at both ends by weld seams, the U web-forming part of the cut-out extending parallel to the weld seam at the end up to closely over the inner fold edges of the side folds and the limbs of the U extending from the ends of the transverse cut up to the outer weld seam edge. In accordance with one conventional production method, the tube sections closed by weld seams are piled up to form an edge-aligned stack and the tank top cut-outs are formed by stamping through the stack. However, stamping of the stack can result in inaccurate positioning of the cut-outs and untidy severed edges.

It is therefore the problem of the present invention to provide an apparatus with which the tank top bag can be produced with exact tank top cut-outs and clean severed edges.

According to the invention, this problem is solved in an apparatus of the aforementioned kind in that the belt conveyor consists of a suction belt conveyor of which the belt is provided with suction holes spaced apart by a larger distance than the tube sections are long, that above a direction-changing drum which is disposed at the receiving end of the belt conveyor and provided with a suction channel for providing the suction holes with suction air there is provided a raisable and lowerable pressure roller of which the drive lowers it onto the direction-changing drum as each suction hole is passed, that jaws are provided on both sides of the feeding plane of the tubular web for clamping the tube section tight upstream of the direction-changing drum and releasing it when the pressure roller is lowered, that near the end of the suction belt conveyor and above same a drum is rotatably mounted which has suction holes at the same spacing along its circumference as does the suction belt, the suction holes suction-attracting the leading edges of the tube sections and taking them from the suction belt conveyor, and that a knife or stamping cylinder cutting out the tank top cut-outs is applied to the drum and the drum is provided with a projectable folding blade which transfers the tank top bags to a conveyor taking same off. The apparatus according to the invention ensures that the tubular web advanced up to the receiving end of the belt conveyor with its leading end that is closed by a weld seam is fed in a correct position from the belt conveyor to the stamping cylinder after the tube section has been severed from the tubular web by a transversely extending severing cut. The section of tubular web is taken along by the belt conveyor at its leading edge at the instant when the latter is suction-attracted by the passing suction hole and simultaneously released by venting the clamping jaws. Proper suction-attraction of the leading edge of the tube section is ensured in that, at the same time as the suction hole passes, the pressure roller presses the leading edge of the tube section against same. The suction holes of the conveyor belt are associated with the suction holes of the suction drum so that the latter correctly receives the tube sections from the conveyor belt and transfers them to the stamping cylinder in the correct position. The tank top cut-outs can be very accurately applied to the tube sections and with clean severed edges because they are accurately located on the drum forming the backing cylinder for the knife. The finished tank top bags can be withdrawn from the suction drum in known manner and stacked.

Desirably, the suction belt and the drum are provided with groups of suction holes, the spacing of the first hole in each group from the first hole of the following group being larger than the tube sections are long and a zone free from suction holes being provided between the groups. The individual tube sections are thereby located on the belt conveyor or suction drum not only by one suction hole but by several. The apparatus of the invention permits tank top bags of different lengths to be made, it being necessary for the shortest sections still to cover the last suction holes of each group to avoid sucking in false air and for the longest sections to terminate in front of the first suction hole of the following group. Further, when changing the lengths of the tank top bags, the knife cylinder and the suction drum acting as its backing cylinder must be reset with respect to each other.

The conveyor belt desirably consists of a plurality of parallel juxtaposed belts.

To avoid slip between the conveyor belts and the driving and direction-changing drums that might affect the accuracy of transfer of the tube sections, the conveyor belts may be provided with teeth laterally of the suction channels covered thereby.

Air jet pipes may be disposed between the pair of feed rollers and the separating welding tool at both sides of the feeding plane of the tubular web to produce an air jet which leads the leading advanced end of the tubular web to the downstream suction belt in a stretched form before the tube sections are welded off.

If the clamping jaws are not formed by the clamping tool itself, they can be disposed between the suction belt conveyor and the separating welding tool. By means of a special clamping jaw it is also possible to maintain in the web a tension which is also sufficient during separating welding.

The folding blade may push the tank top bags into the holding tongs of a depositing and stacking cylinder while folding them transversely. In this way it is possible to form stacks of transversely folded tank top bags from which individual tank top bags can be simply removed by engaging them within their tank top cut-outs.

Transverse folding can also be effected eccentrically in that the parts disposed laterally of the cut-out project beyond the base weld seam. If these projecting portions are still interconnected by a web of material, the stack of transversely folded tank top bags can be suspended from a mounting from which the bags can be individually pulled off. The web connecting the side portions may be formed by stamping out a rectangular cut-out, it being preferred to provide lines of perforations between the side portions and the webs so that the webs can be more easily torn off during use of the bags.

For the purpose of mounting the stacks of bags, the side portions may also be provided with inwardly directed flaps.

One example of the invention will now be described in more detail with reference to the drawing, wherein.

Figure 1:
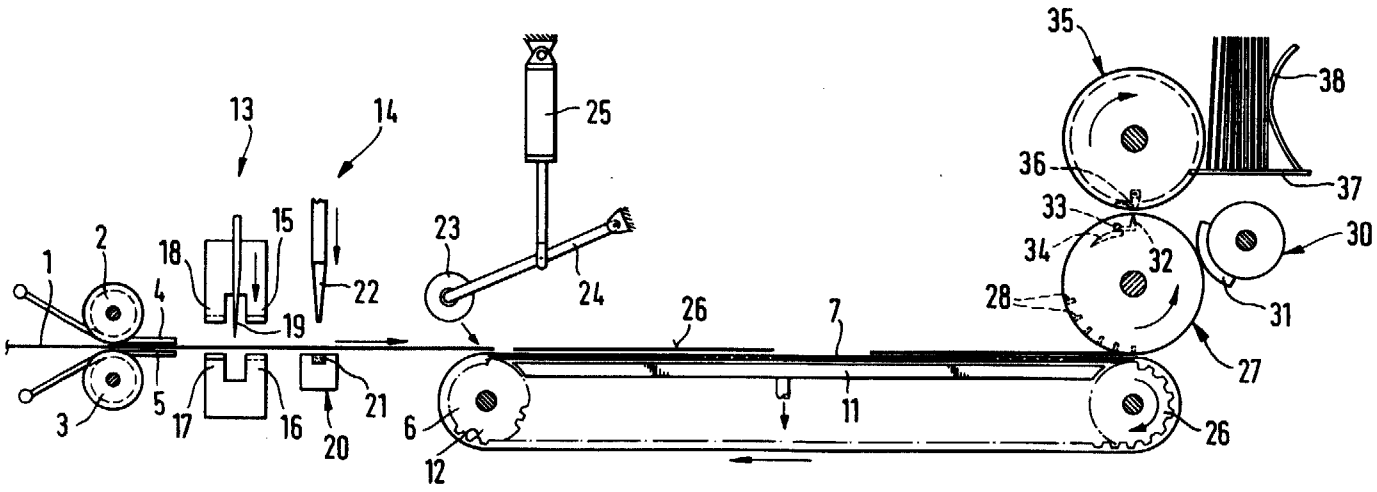
FIG. 1 is a diagrammatic side elevation of the apparatus.
Figure 2:
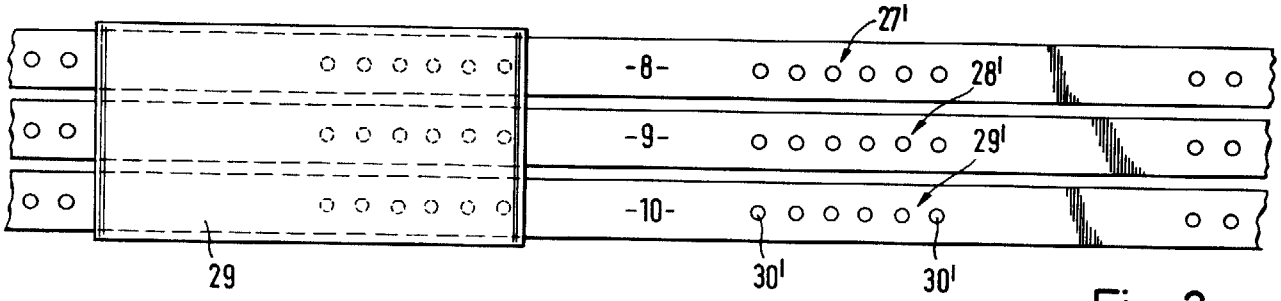
FIG. 2 is a plan view of the belts of the suction belt conveyor.

A tubular web 1 provided with side folds and withdrawn from a supply reel (not shown) is intermittently fed by the length of one section by means of feed rollers 2, 3. Rows of air jet tubes 4, 5 are arranged in a comb-like manner in rows in circumferential grooves of the feed rollers 2, 3 and produce an air jet which leads the leading end of the tubular web 1 in a stretched form to the receiving end of the belt conveyor 7. Between the pair of feed rollers 2, 3 and a drum for changing the direction of movement of a suction belt conveyor, that is, a deviation or the front direction-changing drum 6 of the suction belt conveyor 7, there are separating welding means 13 and at a spacing therefrom there are clamping means 14. The separating welding means 13 consist of the usual welding jaws 15, 16 and 17, 18 which are movable towards each other and between which the severing knife 19 is arranged.

The clamping means 14 consist of a lower jaw 20 containing a bar 21 of elastomeric material and a push rod 22 which can be lowered onto the bar. A pressure drum 23 which can be lowered onto the front direction-changing drum 6 of the suction belt conveyor 7 is pivoted to the machine frame on a lever 24 and moved by the piston-cylinder unit 25.

Three parallel juxtaposed suction belts 8, 9, 10 passing over the direction-changing drum 6 as well as the driving drum 26 are provided at their edges with teeth 12 and their central regions cover suction air channels 11. The front direction-changing drum 6 is also provided with suction channels so that the tubular web sections are already suction-attracted in the region of this direction-changing drum.

The suction belts are provided with groups 27', 28', 29' of suction holes 30' which follow each other at equal spacings. Above the end of the suction belt conveyor 7 there is a driven suction drum 27 which is likewise provided with groups 28 of suction holes of which the first suction holes suction-attract the tubular web section 29 at its leading edge and take it from the suction belt conveyor 7. The suction drum 27 is also constructed as a backing cylinder for a stamping cylinder 30 which is applied to it and has a stamping knife 31 for cutting out the tank top cut-outs.

The suction drum 27 is provided with a folding knife 32 which can be projected along a peripheral line of the drum and is actuated by a cam 34 by way of a cam roller 33. The suction drum 27 co-operates with the withdrawing and folding cylinder 35 which is provided with folding tongs 36. The folding blade 32 is controlled so that it is projected in the contacting zone of the cylinders 27, 35 and transfers the bags with tank top cut-outs to the folding tongs 36 along a transverse fold.

Applied to the folding and depositing cylinder 35 there is a support 37 which engages in peripheral grooves of the folding cylinder 35 and on which the transversely folded tank top bags are deposited, the bags being held between the surface of the cylinder 35 and a retaining spring 38. The finished sacks of transversely folded tank top bags can be withdrawn from the support 37.

The apparatus operates as follows: As soon as the tubular web in the air jet has been advanced by the length of one section, the push rod 22 is lowered onto the clamping jaw 20 and the separating welding tool 13 closes, whereby the tubular web is provided with two parallel weld seams and the tubular web section 29 is severed from it by a severing cut passing between the weld seams. After the welding jaws have opened again, the pressure roller 23 presses, with simultaneous opening of the clamping means 14, the leading edge of the tubular web 29 onto the first suction holes of the suction belt 7 so that the tube section 29 is taken away in the correct position. Since the tube sections are also received by the suction drum 27 in the correct position, the tank top cut-outs can be applied exactly with the aid of the knife cylinder 30.

Figure 3:
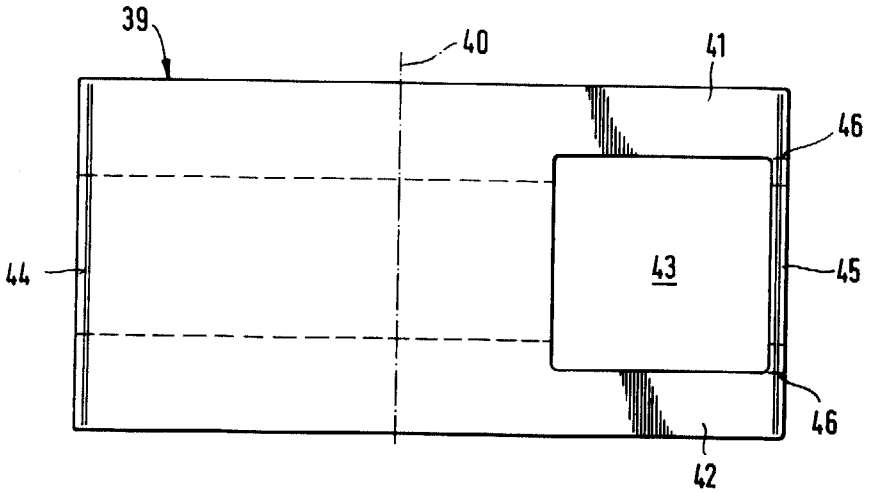
FIG. 3 is a plan view of a tank top bag.

The tank top bag 39 with a cut-out 43 as shown in FIG. 3 can be transversely folded by the folding blade 32 and the folding tongs 36 out of centre about the chain-dotted line 40 so that the ends of the side portions 41, 42 project beyond the base weld seam 44 of the tank top bag 39. The side portions 41, 42 can be interconnected by a web 45 which can be torn off from the side portions 41, 42 along the lines 46 of perforations.

I claim:

1. Apparatus for making tank top bags from an intermittently fed web of tubular plastics film provided with side folds, comprising: cyclically operating transverse welding and separating means for severing tube sections from an intermittently fed web and for forming weld seams at both ends of the severed tube sections; first conveyor means for taking the tube sections away from said welding and separating means; and stamping means for cutting out tank top cut-outs from the welded tube sections, said first conveyor means comprising a suction belt conveyor means (7) comprising at least one belt (8, 9, 10) provided with a first plurality of suction holes (30') spaced apart by a larger distance than the length of the severed tube sections (29), direction-changing drum means (6) for changing the conveying direction of said suction belt conveyor means disposed at and encompassed within a receiving end of the suction belt conveyor means (7), said direction-changing drum means being provided with a suction channel for providing the suction holes of said suction belt conveyor means with suction air, a raisable and lowerable pressure roller (23) positioned above said direction-changing drum means, drive means (25) for moving said pressure roller towards said direction-changing drum means (6) as suction holes pass said direction-changing drum means, jaw means (20, 21, 22) provided on both sides of a feeding plane of the tubular web (1) for clamping a severed tube section (29) upstream of the direction-changing drum means (6) and for releasing the clamped severed section when the pressure roller (23) is lowered; suction drum means (27) rotatably mounted above a delivery end of said suction belt conveyor means having a second plurality of suction holes at the same spacing along its circumference as the spacing between suction holes in said at least one belt (8, 9, 10), the second plurality of suction holes (28) suction-attracting leading edges of tube sections for taking attracted tube sections from the suction belt conveyor means (7), said stamping means comprising means movable towards and cooperating with said suction drum means (27) for cutting out tank top cut-outs (43) from said tube sections; said suction drum means (27) carrying projectable folding blade means (32) for transferring the tank top bags; means for controlling movement of said blade means; and second conveyor means (35) for receiving transferred tank top bags and for conveying received bags away from said suction drum means.

2. Apparatus according to claim 1, wherein said at least one suction belt (8, 9, 10) includes groups (27', 28', 29') of suction holes, the spacing of the first hole in each group (27', 28', 29') from the first hole of the following group being larger than the length of severed tube sections (29), a zone free from suction holes being provided between each of said groups.

3. Apparatus according to claim 1 or claim 2, characterized in that said suction belt conveyor means comprises a plurality of parallel juxtaposed belts (8, 9, 10).

4. Apparatus according to claim 3, wherein said first conveyor means further comprises suction channel means (11) for feeding suction to said belts, and wherein said plurality of belts (8, 9, 10) have teeth (12) laterally of the suction channel means (11) covered thereby.

5. Apparatus according to claim 3, wherein said transverse welding and separating means includes a separating welding tool (13), and wherein said apparatus further comprises a pair of feed rollers (2, 3) for feeding a web to said transverse welding and separating means, and air jet pipes (4, 5) disposed between the pair of feed rollers (2, 3) and the separating welding tool (13) at both sides of a feeding plane of the tubular web (1).

6. Apparatus according to claim 5, wherein said transverse welding and separating means comprises clamping jaws (20, 21, 22) disposed between the belt conveyor means (7) and the separating welding tool (13).

7. Apparatus according to claim 3, wherein said second conveyor means (35) comprises holding tongs (36), and wherein said folding blade means (32) pushes the tank top bags into the holding tongs (36) while folding them transversely.

8. Apparatus according to claim 1, wherein said means for controlling movement of said blade means comprises a cam roller (33) connected to said blade means and a cam (34) contacted by said cam roller during rotation of said suction drum means.

* * * * *